US005772017A

United States Patent [19]

Kang

[11] Patent Number: 5,772,017

[45] Date of Patent: Jun. 30, 1998

[54] BEVERAGE MIXING DISPENSER DEVICE

[76] Inventor: Heung Sun Kang, 157-26 Quince Ave., Flushing, N.Y. 11355

[21] Appl. No.: 738,297

[22] Filed: Oct. 25, 1996

[51] Int. Cl.[6] ..... B65D 25/08; B67D 5/00

[52] U.S. Cl. ..... 206/222; 215/DIG. 8; 222/83; 426/115; 426/120

[58] Field of Search ..... 206/219, 222; 215/DIG. 8; 222/83, 83.5, 80; 426/115, 120

[56] References Cited

U.S. PATENT DOCUMENTS

| | | | |
|---|---|---|---|
| 3,603,469 | 9/1971 | Magni | 206/222 |
| 3,715,189 | 2/1973 | Nighohossian et al. | 206/222 X |
| 3,968,872 | 7/1976 | Cavazza | 206/222 |
| 4,195,730 | 4/1980 | Hunt | 215/DIG. 8 |
| 4,195,731 | 4/1980 | Cavazza | 206/222 |
| 4,221,291 | 9/1980 | Hunt | 206/222 |
| 4,408,690 | 10/1983 | Ferrero | 206/222 |
| 4,615,437 | 10/1986 | Finke et al. | 206/222 |
| 4,858,760 | 8/1989 | Di Sturco | 206/222 |
| 4,903,865 | 2/1990 | Janowitz | 222/83.5 |
| 4,982,875 | 1/1991 | Pozzi et al. | 222/83 |
| 5,029,718 | 7/1991 | Rizzardi | 206/222 X |
| 5,038,951 | 8/1991 | Rizzardi | 206/222 X |

*Primary Examiner*—Bryon P. Gehman
*Attorney, Agent, or Firm*—Michael I. Kroll

[57] ABSTRACT

A beverage mixing dispenser device (10) for a bottle (12) having a body (14) and a neck (16) for holding a beverage (18) therein. The device (10) comprises a container (20 ) for insertion into the neck (16) of the bottle (12). The container (20) is for retaining a separate ingredient (22) therein. A removable closure member (24) is connected to the container (20). The removable closure member (24) is adapted to close the neck (16) of the bottle (12). A structure (26) extends through the removable closure member (24) and the container (20), for opening the bottom of the container (20), so that the ingredient (22) can drop down and mix with the beverage (18) within the body (14) of the bottle (12).

18 Claims, 7 Drawing Sheets

BEVERAGE MIXING DISPENSER DEVICE

BACKGROUND OF THE INVENTION

1. Field of the Invention

The instant invention relates generally to containers and more specifically it relates to a beverage mixing dispenser device.

2. Description of the Prior Art

Numerous containers have been provided in prior art. For example, U.S. Pat. Nos. 3,134,577 to Bollmeier; 4,272,199 to Hade; 4,387,998 to Szigeti and 5,246,142 to DiPalma et al. all are illustrative of such prior art. While these units may be suitable for the particular purpose to which they address, they would not be as suitable for the purposes of the present invention as heretofore described.

BOLLMEIER, EMIL WAYNE CONTAINER

U.S. Pat. No. 3,134,577

A multiple-compartment storing and mixing device comprising an open-ended outer container, an open-ended inner container, a cover and a generally flat sharp-edged mixing member. A fastener means is for centrally engaging the mixing member with the cover and within the inner and outer containers. A handle means is attachable to the mixing member for disengaging the mixing member from the cover and for forcing the mixing member through the inner container.

HADE, HORACE A. MIXING CONTAINER

U.S. Pat. No. 4,272,199

A mixing container in which two or more completely incompatible materials may be packaged, stored, and prior to use mixed together. The mixing container comprises an exterior container and one or more interior containers. The largest volume material of those being stored is placed within the exterior container. The other incompatible materials are placed within the interior containers, respectively. A shaft extends into the exterior container. Affixed to the inner end of the shaft is a rotor. The shaft and the rotor can both rotate and move axially of the shaft. Each of the interior containers are breakable and may be broken by contact with the rotor. The rotor is also capable of completely mixing the contents of each of the containers, whereby various incompatible materials may be completely and homogeneously mixed prior to use. The exterior container of the invention may be modified with a nozzle and means for dispensing the mixture through the nozzle.

SZIGETI, ELEMER DEVICE FOR MIXING AND DISTRIBUTING A TWO-CONSTITUENT PRODUCT

U.S. Pat. No. 4,387,998

A mixing and distributing device for a two constituent product, notably for the formation of a foam in situ, comprises a first and a second interfitted compartment having an inner end and an outer end separated by a web. Means are provided for tearing the web under the effect of the axial approach movement of the compartments through their inner ends. The walls of the latter including complementary threads designed to cooperate to bring about the approach. Each compartment comprises a solid portion and a hollow portion in the form of a substantially semicylindrical trough bounded by a longitudinal surface. The first compartment comprising a removable plug at its outer end and the web at its inner end. The second compartment is closed at its outer end and is provided at its other end, on the one hand, with a peripheral projection forming a cutting-out knife for the web and, on the other hand, an axial tit projecting with respect to the inner end of its solid portion.

DiPALMA, ELIO DiPALMA, JOSEPHINE DEVICE FOR STORING TWO PRODUCTS SEPARATELY AND SUBSEQUENTLY MIXING THEM

U.S. Pat. No. 5,246,142

A novel mixing and dispensing container is provided herein. The novel container includes a container for containing a first ingredient. The container including an internal shoulder therein. A dispenser compartment for insertion into the container is for storing a second ingredient which is segregated from the first ingredient prior to use. The dispenser compartment has a preformed weakened region in a selected wall thereof. A removable closure is for the container. The removable closure is connected to the dispensing compartment. The removable closure is adapted to close the container. A projection on the dispenser compartment is for engaging the shoulder during removal of the closure. Opening of the container by removal of the removable closure causes the projection on the dispenser compartment to engage the shoulder in the container. This permits another portion of the dispenser compartment to be raised with respect to the container. This, in turn, ruptures the weakened region of the selected wall of the dispenser compartment, and consequently dispenses the second ingredient into the first ingredient.

SUMMARY OF THE INVENTION

A primary object of the present invention is to provide a beverage mixing dispenser device that will overcome the shortcomings of the prior art devices.

Another object is to provide a beverage mixing dispenser device that will protect beverages by preventing a chemical interaction between a main beverage and a separately contained ingredient until released by a consumer.

An additional object is to provide a beverage mixing dispenser device that will allow the consumer to choose whether to add the separately contained ingredient to the main beverage and to insert a straw through the device by removing a stem and knob from the device, after the separately contained ingredient is released into the main beverage.

A further object is to provide a beverage mixing dispenser device that is simple and easy to use.

A still further object is to provide a beverage mixing dispenser device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 1:
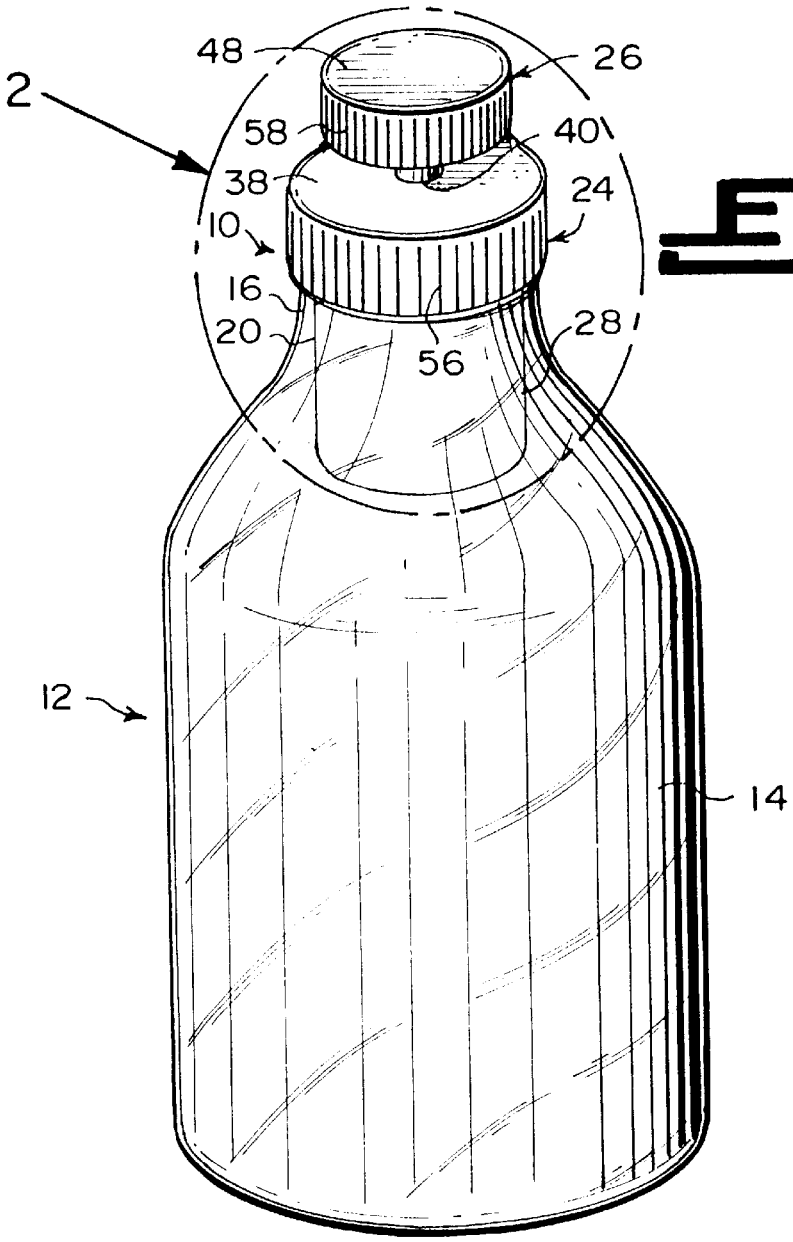
FIG. 1 is a perspective view showing the instant invention disposed in a neck of a bottle before activation.
Figure 2:
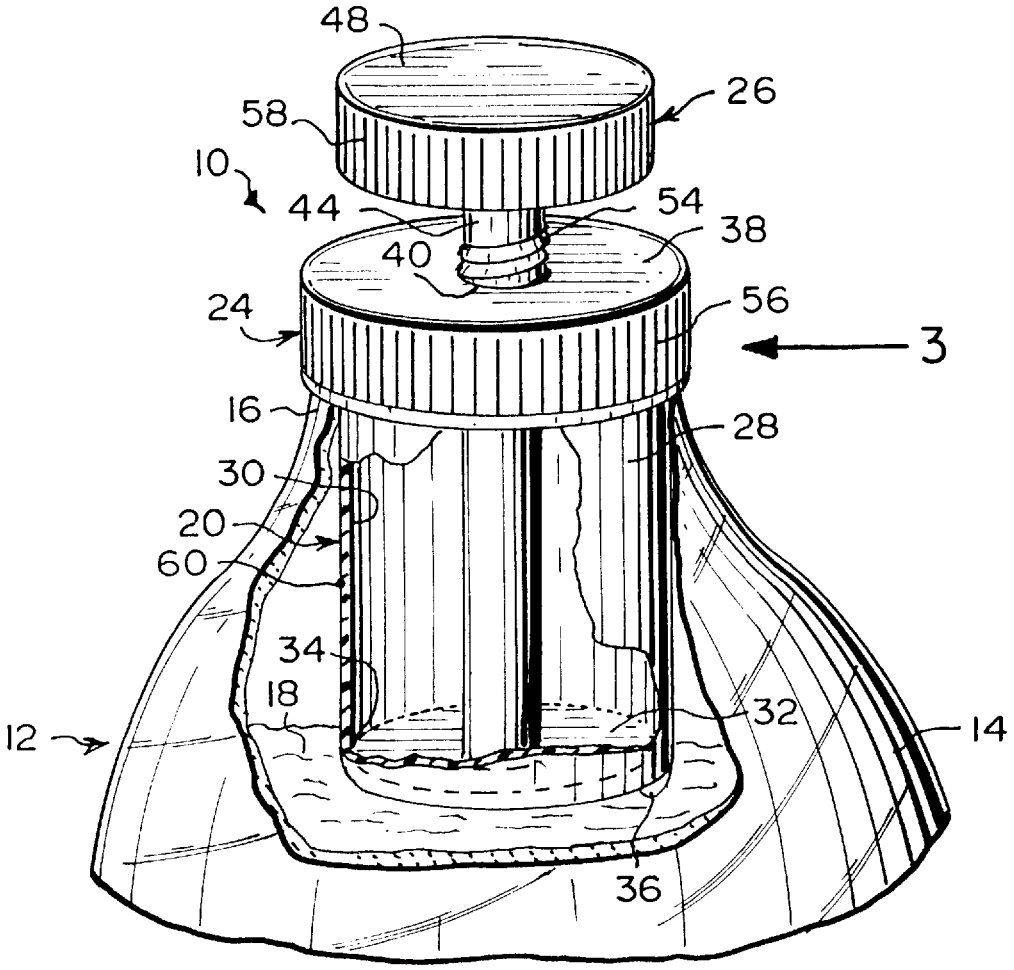
FIG. 2 is an enlarged perspective view of the area indicated by arrow 2 in FIG. 1, with parts broken away and in section.
Figure 3:
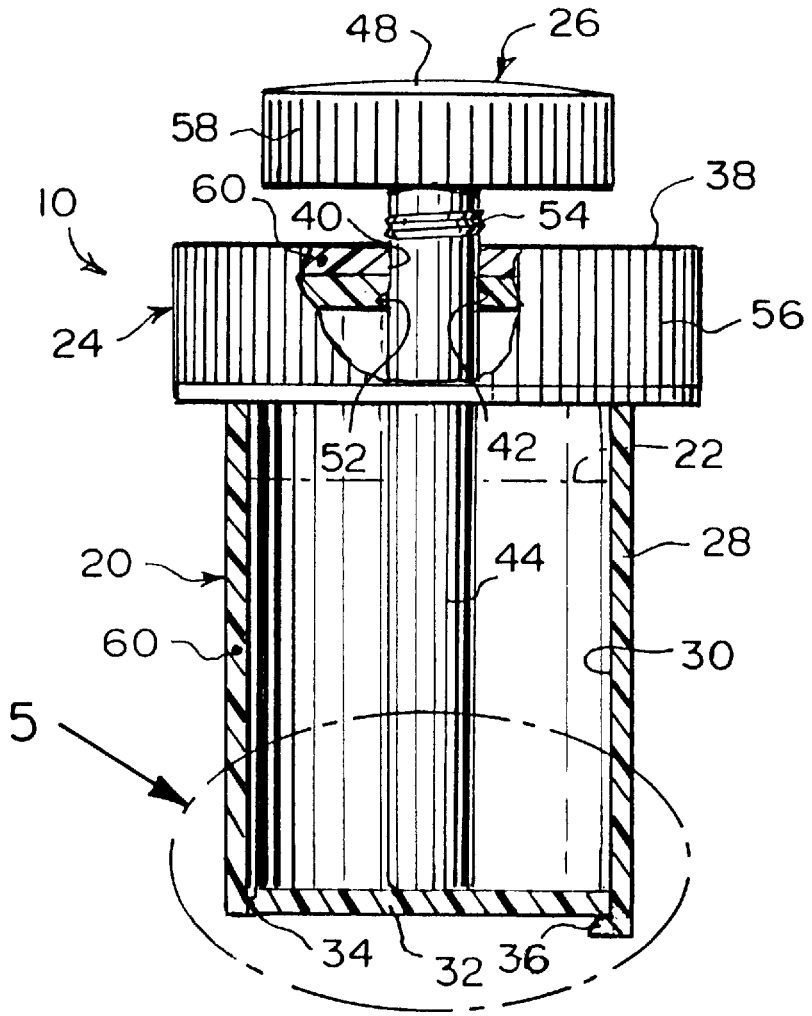
FIG. 3 is an elevational view taken in the direction of arrow 3 in FIG. 1 of the instant invention per se, with parts broken away and in section.
Figure 4:
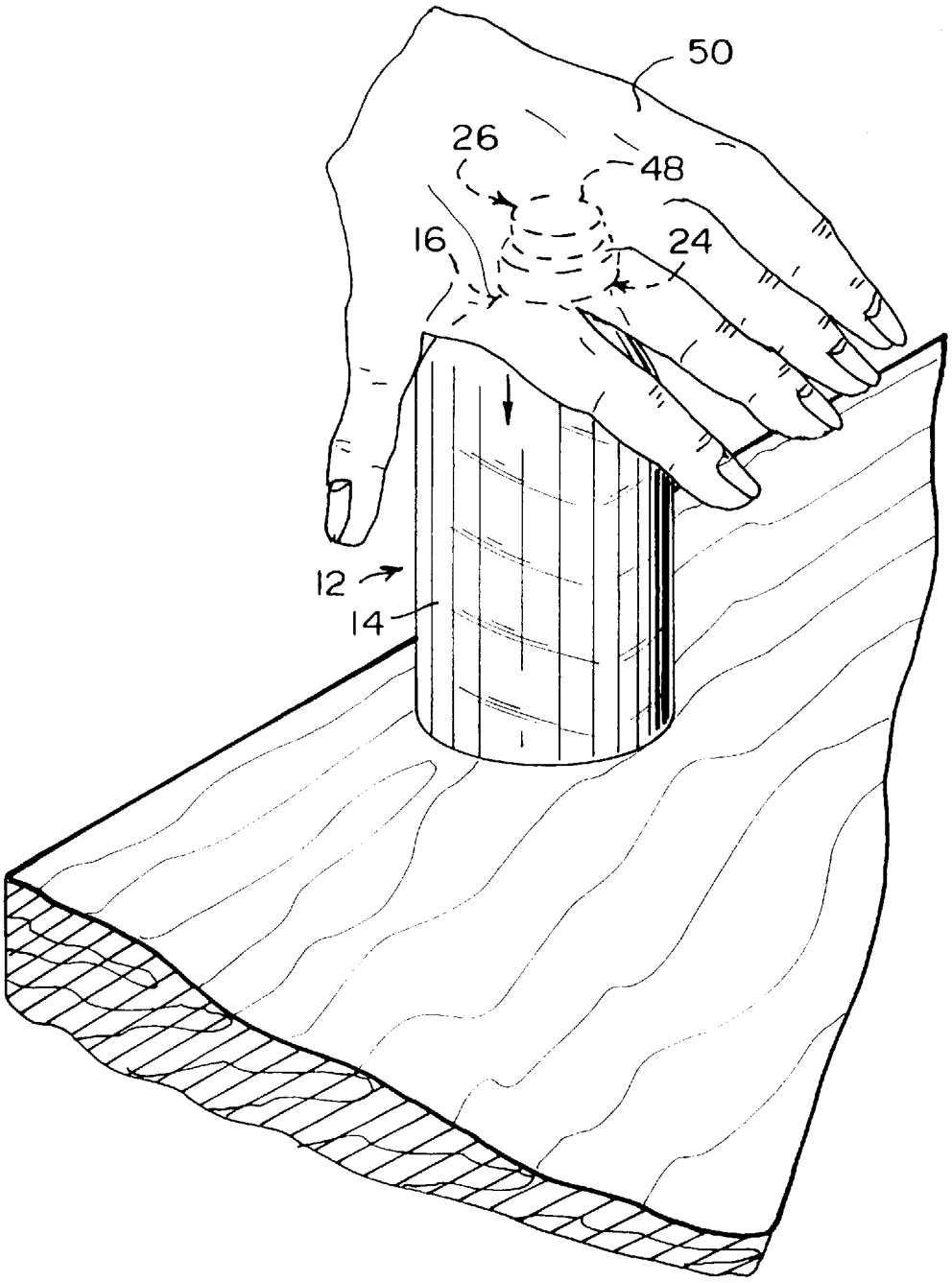
FIG. 4 is a perspective view of the bottle on a support surface, showing the instant invention being activated by a hand of a person.
Figure 5:
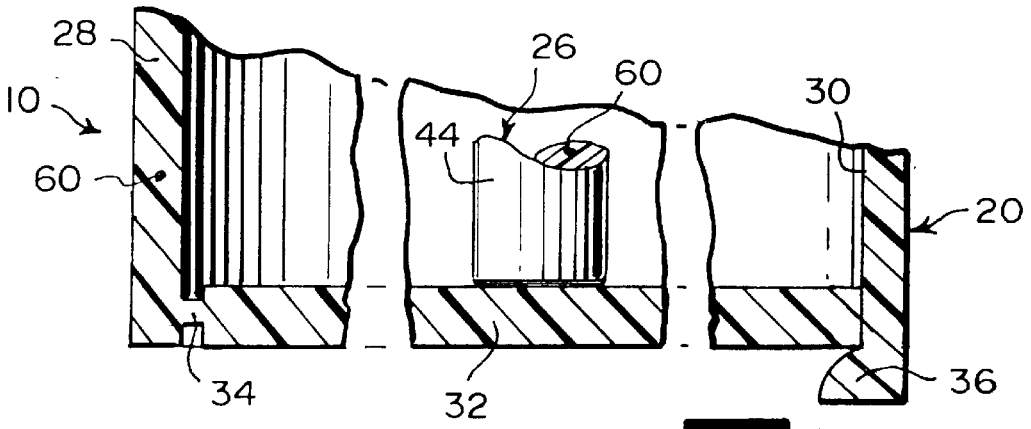
FIG. 5 is an enlarged view of the area indicated by arrow 5 in FIG. 3, showing the bottom lid in greater detail before being opened.
Figure 6:
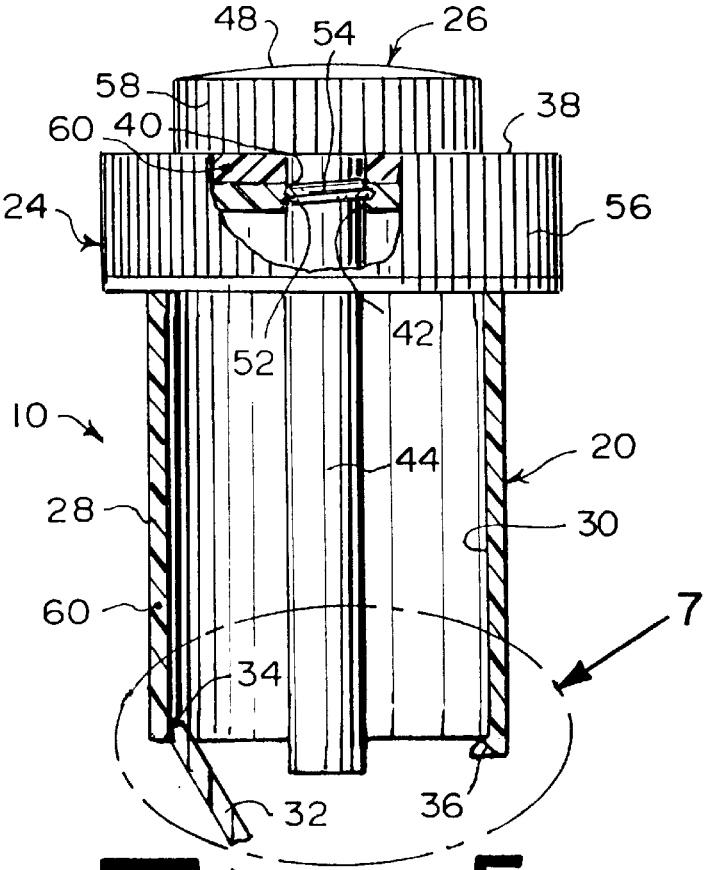
FIG. 6 is an elevational view similar to FIG. 3, showing the bottom lid after being opened.
Figure 7:
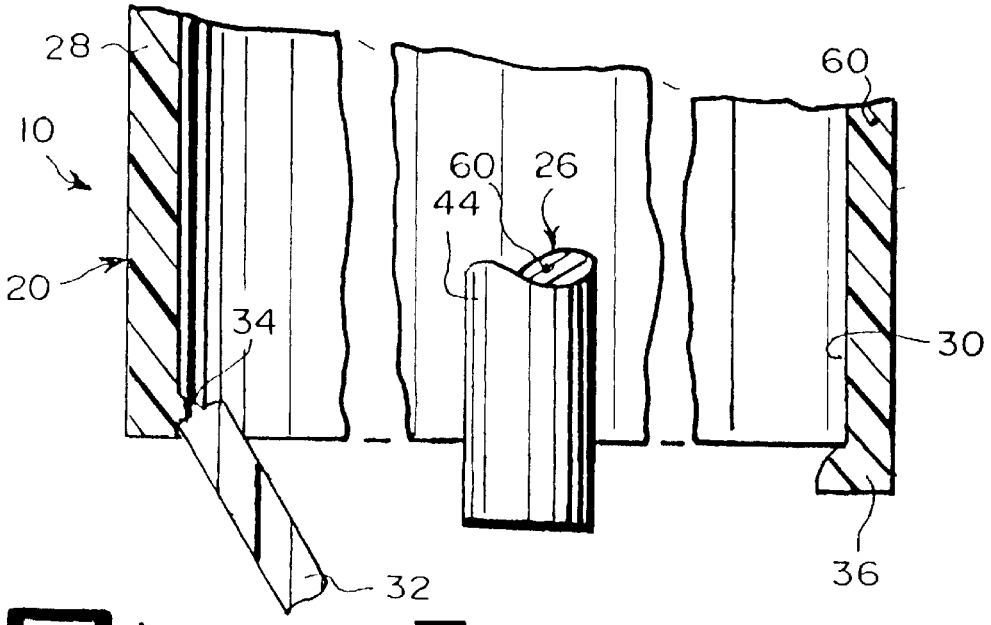
FIG. 7 is an enlarged view of the area indicated by arrow 7 in FIG. 6, showing the bottom lid in greater detail after being opened.
Figure 8:
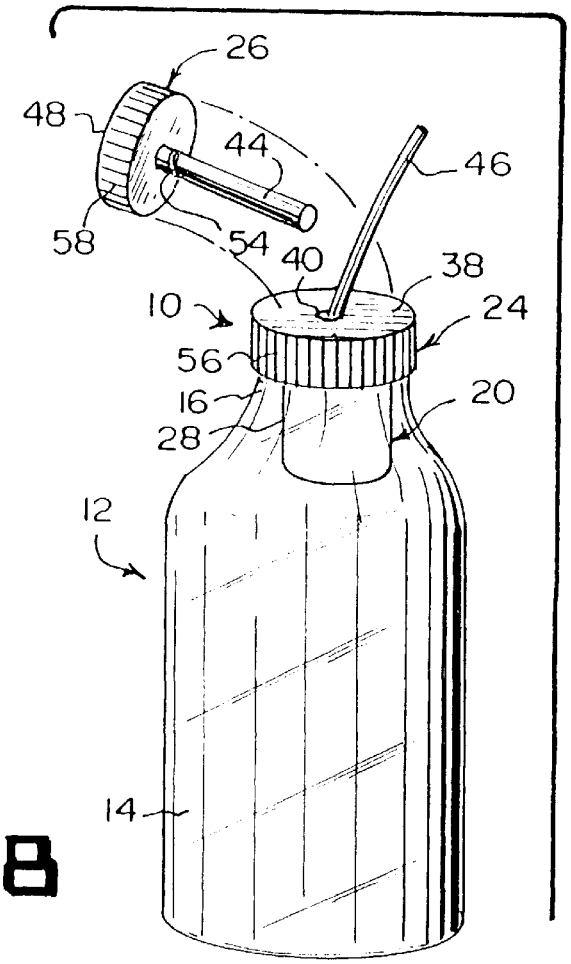
FIG. 8 is a perspective view of the bottle with the knob and stem of the instant invention being removed and a straw being inserted through a hole in the screw cap.
Figure 9:
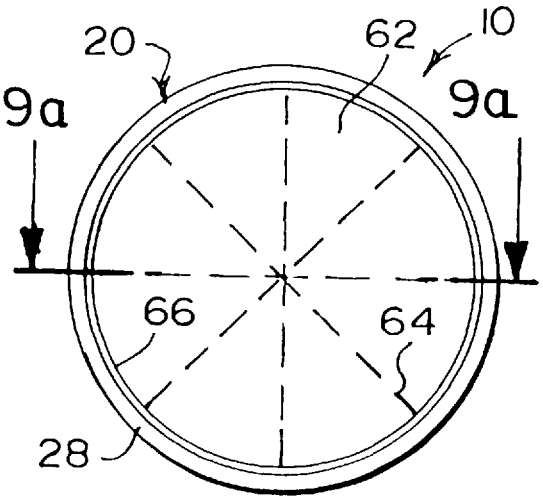
FIG. 9 is a bottom view of the instant invention, showing a modified bottom lid with score marks.
Figure 9A:
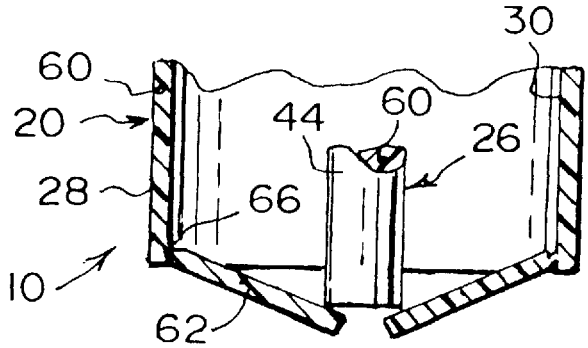

FIG. 9*a* is a cross sectional view taken along line 9*a*—9*a* in FIG. 9 of a lower portion of the container, showing the modified bottom lid after being opened.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 to 8 illustrate a beverage mixing dispenser device 10 for a bottle 12 having a body 14 and a neck 16, for holding a beverage 18 therein. The device 10 comprises a container 20 for insertion into the neck 16 of the bottle 12. The container 20 is for retaining a separate ingredient 22 therein. A removable closure member 24 is connected to the container 20. The removable closure member 24 is adapted to close the neck 16 of the bottle 12. A structure 26 extends through the removable closure member 24 and the container 20, for opening the bottom of the container 20, so that the ingredient 22 can drop down and mix with the beverage 18 within the body 14 of the bottle 12.

The container 20 is a cylindrical receptacle 28, having a chamber 30 therein for the separate ingredient 22 and is sized to fit into the neck 16 of the bottle 12. The container 20 includes a bottom pop out lid 32, to release the separate ingredient 22 therefrom.

The container 20 further includes a hinge 34 formed between one side of the bottom pop out lid 32 and the container 20. A stop 36 is formed on the container 20 opposite from the hinge 34, to hold the bottom pop out lid 32 closed.

The neck 16 of the bottle 12 contains external threads thereon. The removable closure member 24 is a screw cap 38 with internal threads to engage with the external threads on the neck 16.

The opening structure 26 includes the removable closure member 24 having a central aperture 40 therethrough. The container 20 has a central opening 42 therethrough, being in alignment with the central aperture 40 in the removable closure member 24. A shaft 44 extends through the central aperture 40 in the removable closure member 24 and the central opening 42 in the container 20, to a top surface of the bottom pop out lid 32. When the shaft 44 is depressed downwardly, the bottom pop out lid 32 will open to release the separate ingredient 22 (see FIGS. 6 and 7). When the shaft 44 is removed, a drinking straw 46 can be inserted through the central aperture 40 in the removable closure member 24 and the central opening 42 in the container 20, to extend into the beverage 18 mixed with the separate ingredient 22 (see FIG. 8).

A knob 48 is affixed to a top end of the shaft 44 that extends upwardly through the central aperture 40 in the removable closure member 24. A palm of a hand 50 of a person, can contact the knob 48 and depress the shaft 44 downwardly to open the bottom pop out lid 32 (see FIG. 4).

The central opening 42 in the container 20 has an internal thread 52 therein. The shaft 44 has an external thread 54 thereon. When the shaft 44 is depressed downwardly, the external thread 54 on the shaft 54 can engage with the internal thread 52 in the central opening 42 in the container 20, to form a seal therebetween and prevent leakage of the beverage 18 mixed with the separate ingredient 22 therefrom.

The screw cap 38 includes a knurled circumference 56, so as to aid in gripping of the screw cap 38 when tightening and loosening the screw cap 38 on the neck 16 of the bottle 12. The knob 48 includes a knurled circumference 58, so as to aid in gripping of the knob 48 when depressing and removing the shaft 44.

The container 20, the removable closure member 24 and the opening structure 26 are all fabricated out of a strong durable material 60. The strong durable material 60 is plastic.

The separate ingredient 22 can be fruit or vegetable concentrates, extracts, pieces of fruit (lemon/lime), flavors, sugars, sugar substitutes (Nutra Sweet sweetners), juices or other powered/particle mixtures for the beverage 18.

FIGS. 9 and 9*a* show the container 20 with a modified bottom lid 62 radially scored at 64 and hinge sealed at 66 about its perimeter to the container 20. When the opening structure 26 contacts the bottom lid 62, the bottom lid will open to release the separate ingredient 22 therefrom.

LIST OF REFERENCE NUMBERS

10 beverage mixing dispenser device
12 bottle
14 body of 12
16 neck of 12
18 beverage in 14
20 container of 10
22 separate ingredient in 20
24 removable closure member of 10
26 opening structure of 10
28 cylindrical receptacle of 20
30 chamber in 28 for 22
32 bottom pop out lid of 20
34 hinge between 32 and 20
36 stop on 20
38 screw cap for 24
40 central aperture in 24
42 central opening in 20

44 shaft
46 drinking straw
48 knob
50 hand of person
52 internal thread in 42
54 external thread on 44
56 knurled circumference on 38
58 knurled circumference of 48
60 strong durable material (plastic) for 20, 24 and 26
62 modified bottom lid of 20
64 radial score on 62
66 hinge seal between 62 and 20

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A beverage mixing dispenser device for a bottle having a body and a neck for holding a beverage therein, said device comprising:

a) a container for insertion into the neck of the bottle, said container retaining a separate ingredient therein and having a bottom pop out lid therein;

b) a removable closure member connected to said container, said removable closure member adapted to close the neck of the bottle; and c) means extending through said removable closure member and said container, for opening said bottom pop out lid of said container, so that said ingredient can drop down and mix with the beverage within the body of the bottle; said opening means including:

i) said removable closure member having a central aperture therethrough;

ii) said container having a central opening therethrough being in alignment with said central aperture in said removable closure member;

iii) a shaft extending through said central aperture in said removable closure member and said central opening in said container to a top surface of said bottom pop out lid, whereby when said shaft is depressed downwardly said bottom pop out lid will open to release the separate ingredient and when said shaft is removed a drinking straw can be inserted through said central aperture in said removable closure member and said central opening in said container to extend into the beverage mixed with the separate ingredient;

iv) said central opening in said container having an internal thread therein; and v) said shaft having an external thread thereon, so that when said shaft is depressed downwardly said external thread on said shaft can engage with said internal thread in said central opening in said container to form a seal therebetween and prevent leakage of the beverage mixed with the separate ingredient therefrom.

2. A beverage mixing dispenser device as recited in claim 1, wherein said container is a cylindrical receptacle having a chamber therein for the separate ingredient and sized to fit into the neck of the bottle.

3. A beverage mixing dispenser device as recited in claim 2, wherein said container further includes:

a) a hinge formed between one side of said bottom pop out lid and said container; and b) a stop formed on said container opposite from said hinge to hold said bottom pop out lid closed.

4. A beverage mixing dispenser device as recited in claim 3, wherein the neck of the bottle includes external threads thereon and said removable closure member is a screw cap with internal threads to engage with the external threads on the neck.

5. A beverage mixing dispenser device as recited in claim 4, wherein said opening means further includes a knob affixed to a top end of said shaft extending upwardly through said central aperture in said removable closure member, so that a palm of a hand of a person can contact said knob and depress said shaft downwardly to open said bottom pop out lid.

6. A beverage mixing dispenser device as recited in claim 5, wherein said screw cap includes a knurled circumference, so as to aid in gripping of said screw cap when tightening and loosening said screw cap on the neck of the bottle.

7. A beverage mixing dispenser device as recited in claim 6, wherein said knob includes a knurled circumference, so as to aid in gripping of said knob when depressing and removing said shaft.

8. A beverage mixing dispenser device as recited in claim 7, wherein said container, said removable closure member and said opening means are all fabricated out of a strong durable material.

9. A beverage mixing dispenser device as recited in claim 8, wherein said strong durable material is plastic.

10. A beverage mixing dispenser device as recited in claim 2, wherein said container includes a bottom lid radially scored and hinge sealed about its perimeter to said container, so that when said opening means contacts said bottom lid, said bottom lid will open to release the separate ingredient therefrom.

11. A beverage mixing dispenser device as recited in claim 1, wherein said container further includes:

a) a hinge formed between one side of said bottom pop out lid and said container; and b) a stop formed on said container opposite from said hinge to hold said bottom pop out lid closed.

12. A beverage mixing dispenser device as recited in claim 11, wherein said opening means further includes a knob affixed to a top end of said shaft extending upwardly through said central aperture in said removable closure member, so that a palm of a hand of a person can contact said knob and depress said shaft downwardly to open said bottom pop out lid.

13. A beverage mixing dispenser device as recited in claim 12, wherein said knob includes a knurled circumference, so as to aid in gripping of said knob when depressing and removing said shaft.

14. A beverage mixing dispenser device as recited in claim 1, wherein the neck of the bottle includes external threads thereon and said removable closure member and said opening internal threads to engage with the external threads on the neck.

15. A beverage mixing dispenser device as recited in claim 14, wherein said screw cap includes a knurled circumference, so as to aid in gripping of said screw cap when tightening and loosening said screw cap on the neck of the bottle.

16. A beverage mixing dispenser device as recited in claim 1, wherein said container, said removable closure member and said opening means are all fabricated out of a strong durable material.

17. A beverage mixing dispenser device as recited in claim 16, wherein said strong durable material is plastic.

18. A beverage mixing dispenser device as recited in claim 1, wherein said container includes a bottom lid radially scored and hinge sealed about its perimeter to said container, so that when said opening means contacts said bottom lid, said bottom lid will open to release the separate ingredient therefrom.

* * * * *